US007040075B2

(12) United States Patent
Seebeger et al.

(10) Patent No.: US 7,040,075 B2
(45) Date of Patent: May 9, 2006

(54) NITROGEN CAP CHUTE END

(75) Inventors: Robert B. Seebeger, Oakland, CA (US); Frank M. Knafelc, Oakland, CA (US); Ronald E. Heiskell, Oakland, CA (US); Kenneth T. Felipe, Oakland, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/928,058

(22) Filed: Aug. 8, 2001

(65) Prior Publication Data

US 2003/0159408 A1 Aug. 28, 2003

(51) Int. Cl.
*B65B 31/02* (2006.01)

(52) U.S. Cl. ..... 53/432; 53/510; 53/315; 53/314; 53/167; 53/431

(58) Field of Classification Search ..... 53/432, 53/485, 510, 315, 313, 314, 167, 431
See application file for complete search history.

(56) References Cited

U.S. PATENT DOCUMENTS

| | | | | |
|---|---|---|---|---|
| 2,372,457 | A | 3/1945 | Stewart | |
| 2,517,569 | A | 8/1950 | Huzenlaub | |
| 2,779,358 | A | 1/1957 | Fechheimer et al. | |
| 2,808,856 | A | 10/1957 | Tiano et al. | |
| 2,931,147 | A | 4/1960 | Bamby | |
| 3,157,011 | A | 11/1964 | Wheatley et al. | |
| 3,477,192 | A | 11/1969 | Brown et al. | |
| 3,545,160 | A | 12/1970 | Jantze et al. | |
| 3,946,534 | A | 3/1976 | Egly | |
| 4,057,951 | A | 11/1977 | Schneider | |
| 4,094,121 | A | 6/1978 | Ganholt | |
| 4,150,744 | A | 4/1979 | Fennimore | |
| 4,347,695 | A | 9/1982 | Zobel et al. | |
| 4,354,611 | A | 10/1982 | Propst et al. | |
| 4,467,846 | A | 8/1984 | Croser | |
| 4,537,043 | A | 8/1985 | Volker et al. | |
| 4,655,029 | A * | 4/1987 | Weiss | 53/432 |
| 4,658,566 | A | 4/1987 | Sanfilippo | |
| 4,703,609 | A | 11/1987 | Yoshida et al. | |
| 4,827,696 | A | 5/1989 | Arends et al. | |
| 4,840,014 | A | 6/1989 | Takehana et al. | |
| 4,848,419 | A | 7/1989 | Damen | |
| 4,869,047 | A | 9/1989 | Nishiguchi et al. | |
| 4,870,801 | A | 10/1989 | Mizandjian et al. | |
| 4,888,936 | A * | 12/1989 | Takahama et al. | 53/510 |

(Continued)

FOREIGN PATENT DOCUMENTS

DE 3108817 A1 9/1982

(Continued)

*Primary Examiner*—John Sipos
*Assistant Examiner*—Christopher Harmon
(74) *Attorney, Agent, or Firm*—Monica Winghart; Joel Hayashida

(57) ABSTRACT

A cap chute end for capping a plurality of in-line containers in an ambient atmosphere includes a fluid manifold having a plurality of first manifold apertures for injecting a first fluid into the plurality of containers. A fluid shoe is operatively adjacent the fluid manifold and has a plurality of shoe apertures for dispensing a second fluid into the plurality of caps and plurality of containers. A frame that supports the fluid shoe is configured to receive a plurality of caps at a receiving end of the frame. A wiper supported at a dispensing end of the frame has a pair of arms operatively adjacent the fluid shoe. The pair of arms is configured to orient the plurality of caps to the plurality of containers.

18 Claims, 10 Drawing Sheets

U.S. PATENT DOCUMENTS 4,905,454 A 3/1990 Sanfilippo et al.
4,934,127 A 6/1990 Risko et al.
4,977,723 A * 12/1990 Dubrulle et al. ..... 53/110
4,987,721 A * 1/1991 Turtschan ..... 53/167
4,987,726 A * 1/1991 Petho et al. ..... 53/510
4,999,978 A 3/1991 Kohlbach et al.
5,020,303 A 6/1991 Vokins
5,033,254 A 7/1991 Zenger
5,071,667 A 12/1991 Giine et al.
5,139,179 A 8/1992 Cecil
5,224,523 A 7/1993 Wardle
5,299,408 A 4/1994 Dupont
5,313,990 A 5/1994 Clüsserath
5,402,833 A 4/1995 Clüsserath
5,564,481 A 10/1996 Clüsserath
5,595,221 A 1/1997 Lagneau
5,617,705 A 4/1997 Sanfilippo et al.
5,634,500 A 6/1997 Clüsserath et al.
5,758,476 A * 6/1998 Van Den Akker et al. .... 53/485
5,799,464 A 9/1998 Olsson
5,802,812 A 9/1998 Heudecker
5,896,727 A 4/1999 Egli et al.
5,916,110 A 6/1999 Sanfilippo et al.
5,960,989 A * 10/1999 Gunderson ..... 221/220
6,077,481 A * 6/2000 Ichida et al. ..... 422/65
6,079,460 A 6/2000 Ballan et al.
6,105,341 A 8/2000 Campbell
6,112,780 A 9/2000 Meheen
6,141,939 A * 11/2000 Pedrotti et al. ..... 53/48.1
6,475,435 B1 * 11/2002 Taggart ..... 422/33

FOREIGN PATENT DOCUMENTS

EP 0 479 037 B1 12/1995

* cited by examiner

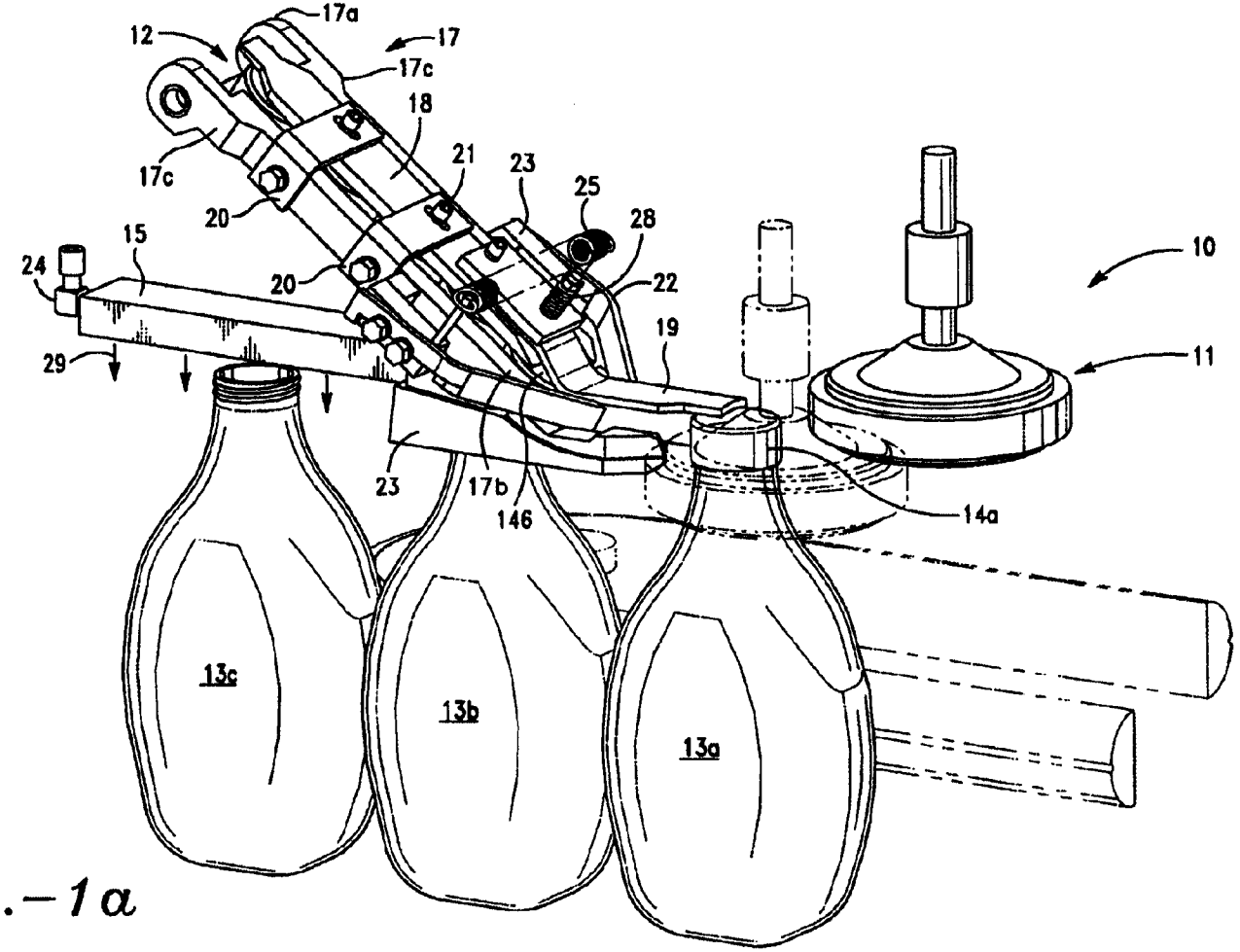
FIG.–1α

NITROGEN CAP CHUTE END

BACKGROUND OF THE INVENTION

The present invention generally relates to apparatus and methods for capping containers and, more specifically, to apparatus and methods of ambient atmosphere capping of high speed, in-line containers having contents that can spoil in the presence of air.

In many applications, containers hold contents that are susceptible to spoilage when exposed to air that may become entrapped in the containers when sealed or capped. These contents may, for example, be foodstuffs such as salad dressings. Specifically, air may be entrapped in the headspace between the upper level of the contents and the container opening. This problem exists for both rotating table machines and straight or in-line capping machines. Rotating machines are generally characterized by having rotating tables that convey containers from one table to another, with each table carrying out a specified function. In-line machines, on the other hand, are generally characterized by having a horizontal moving conveyor which carries filled containers at about 250 containers per minute successively past a cap feeding device, a cap applicator device, and a cap sealing device.

In an effort to address the above problem of entrapped air, early filling and sealing/capping processes have been carried out in a vacuum chamber. Since then, sealing and capping methods have been designed to inject an inert gas into the filled or unfilled containers. This is intended to expel air before the container is sealed or capped. In some methods, a vacuum environment has still been needed for evacuating the containers before the inert gas is injected. In at least one method, the container must be evacuated simultaneously with injecting an inert gas. Also, the process of injecting the inert gas has been designed to occur in an inert gas chamber or other inert type of environment.

Like the many methods of capping, the number of different apparatus employed to inject the inert gas and cap the container has been many. In one design shown in U.S. Pat. No. 4,703,609, a nozzle is provided with a plurality of apertures to inject a liquefied gas into a single container to reduce vaporization of the gas and to reduce the amount of liquefied gas falling into spaces between moving containers. Although the containers are to be immediately sealed, the apparatus for doing so is unclearly described.

A gassing rail is disclosed in U.S. Pat. No. 4,827,696 for injecting an inert gas through a plurality of bores and into the headspace of in-line containers. The gassing rail is described as being mounted to the underside of a chute that seats end units or caps onto passing containers. Nevertheless, it is unclear how the gassing rail works in conjunction with the chute, if at all.

Similarly, U.S. Pat. No. 5,916,110 provides a gas-purging rail adjacent to a separate lid placement system. The gas-purging rail extends above the in-line moving containers and includes a plenum having openings to allow an inert gas to flow into the containers. At a line speed of 400 containers per minute, the plenum is approximately 12 feet long. Again, however, it is unclear how the gas-purging rail operates in conjunction with the lid placement system.

Unfortunately, the past methods and apparatus for capping containers in the absence of air in the headspace have disadvantages. The need for expensive vacuum and/or inert gas chambers has made the sealing or capping process expensive. It has also made it slow due to the requirement of moving containers in and out of either a vacuum or inert gas chamber. In fact, even greater time is required when the containers must be stopped to inject an inert gas, conveyed, and then stopped again for applying a cap. Likewise, the apparatus employed has not provided integrated inert gas injection and capping to prevent ambient air from re-entering the containers in an ambient atmosphere. Rather, a non-integrated or discontinuous gas injection and capping has been provided. Also, past apparatus has not provided for increased line speed to consequently reduce manufacturing time and expense.

As can be seen, there is a need for an improved apparatus and method that integrally removes air from the headspace and places caps on in-line moving containers, can be adapted to various sized headspaces, is effective in ambient atmosphere, and allows high in-line speeds of at least about 275 containers per minute.

SUMMARY OF THE INVENTION

In one aspect of the present invention, a cap chute end subassembly for capping a plurality of in-line containers in an ambient atmosphere comprises a fluid manifold having a plurality of first manifold apertures for injecting a first fluid into the plurality of containers; a fluid shoe operatively adjacent the fluid manifold; the fluid shoe having a plurality of shoe apertures for dispensing a second fluid into the plurality of caps and plurality of containers; a frame that supports the fluid shoe; the frame being configured to receive a plurality of caps at a receiving end of the frame; a wiper supported at a dispensing end of the frame; a pair of arms operatively adjacent the fluid shoe; and the pair of arms being configured to orient the plurality of caps to the plurality of containers.

In another aspect of the present invention, a method of capping a plurality of in-line containers in an ambient atmosphere comprises injecting a first fluid into the plurality of containers; injecting a second fluid into the plurality of containers after injecting the first fluid; orienting a plurality of caps to the plurality of containers; injecting the second fluid into the plurality of caps after orienting the plurality of caps; and placing the plurality of caps onto the plurality of containers after injecting the second fluid into the plurality of caps.

These and other features, aspects and advantages of the present invention will become better understood with reference to the following drawings, description and claims.

BRIEF DESCRIPTION OF THE DRAWINGS

FIG. 1*a* is a partial perspective top view of a capping assembly according to an embodiment of the present invention;

DETAILED DESCRIPTION OF THE INVENTION

An improved apparatus and method is provided by the present invention that integrally removes air from the headspace of and places caps on in-line moving containers. In doing so, air that may otherwise become entrapped in the containers when sealed or capped is prevented. So prevented, spoilage to container contents, for example, foodstuffs such as salad dressings, is minimized. The present invention can be adapted to various sized headspaces, container configurations, and cap sizes. Importantly, the present invention is effective in an ambient atmosphere, and allows high in-line speeds of at least about 275 containers per minute.

The present invention generally provides a capping assembly that may include a chute end subassembly that can integrally provide a continuous injection of a non-oxygen bearing (i.e., less than about 8–12% oxygen) fluid (e.g., liquid or gas), such as an inert fluid or gas like nitrogen and hydrogen into the headspace of in-line moving containers, as well as orienting and then placing the caps on the moving containers. Thereby, the flow of non-oxygen bearing fluid from the chute end subassembly is continuously injected into the containers until the caps are placed on the containers for subsequent tightening. This is unlike the prior art of discontinuous or non-integrated gas injection and capping. The chute end subassembly of the present invention may also inject a non-oxygen bearing fluid not only directly into the containers but also indirectly into the containers. This indirect injection may be achieved by injecting the fluid into the caps, and then deflecting the fluid from the caps and into the containers.

Figure 1B:
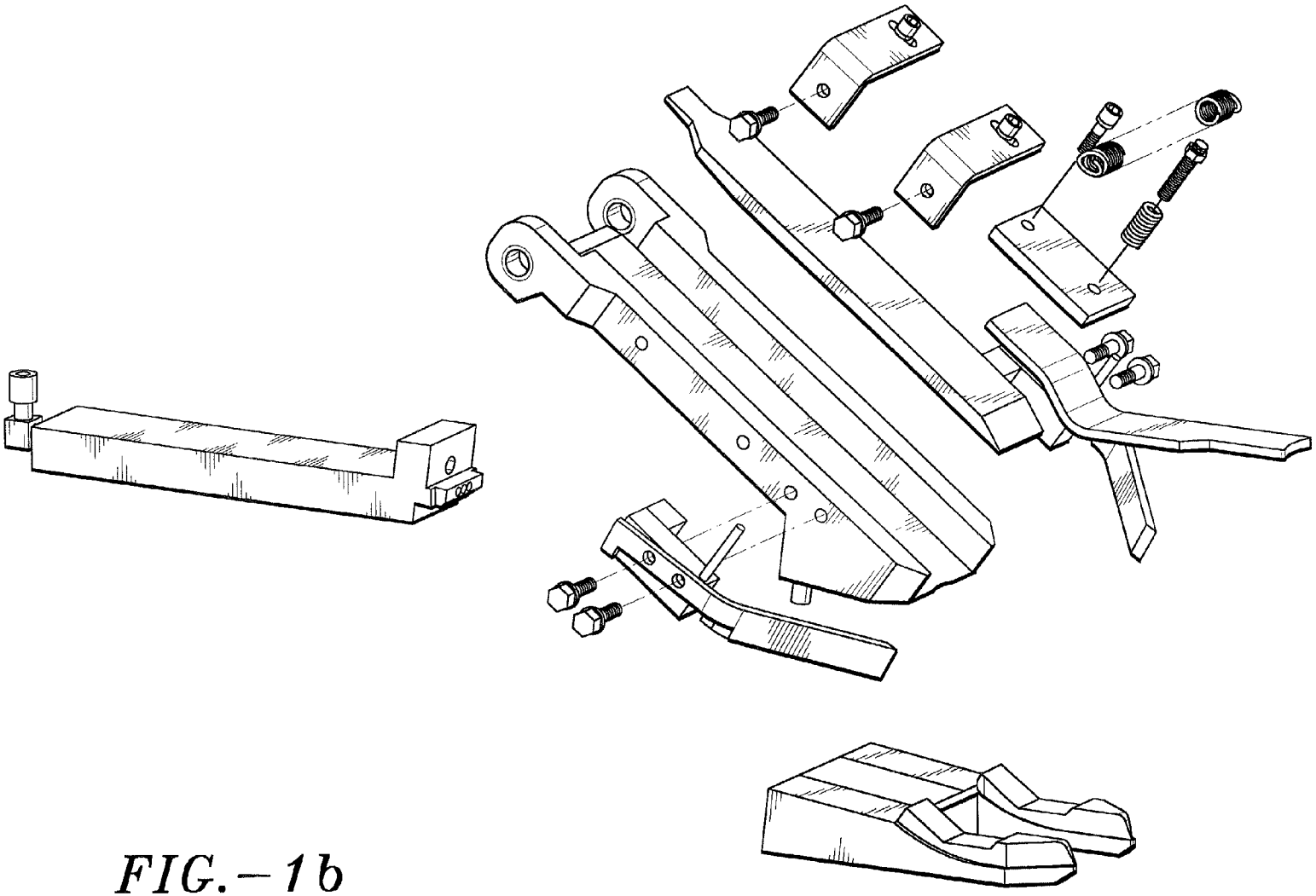
FIG. 1*b* is an exploded perspective view of a chute end subassembly of the capping assembly shown in FIG. 1*a;*
Figure 2:
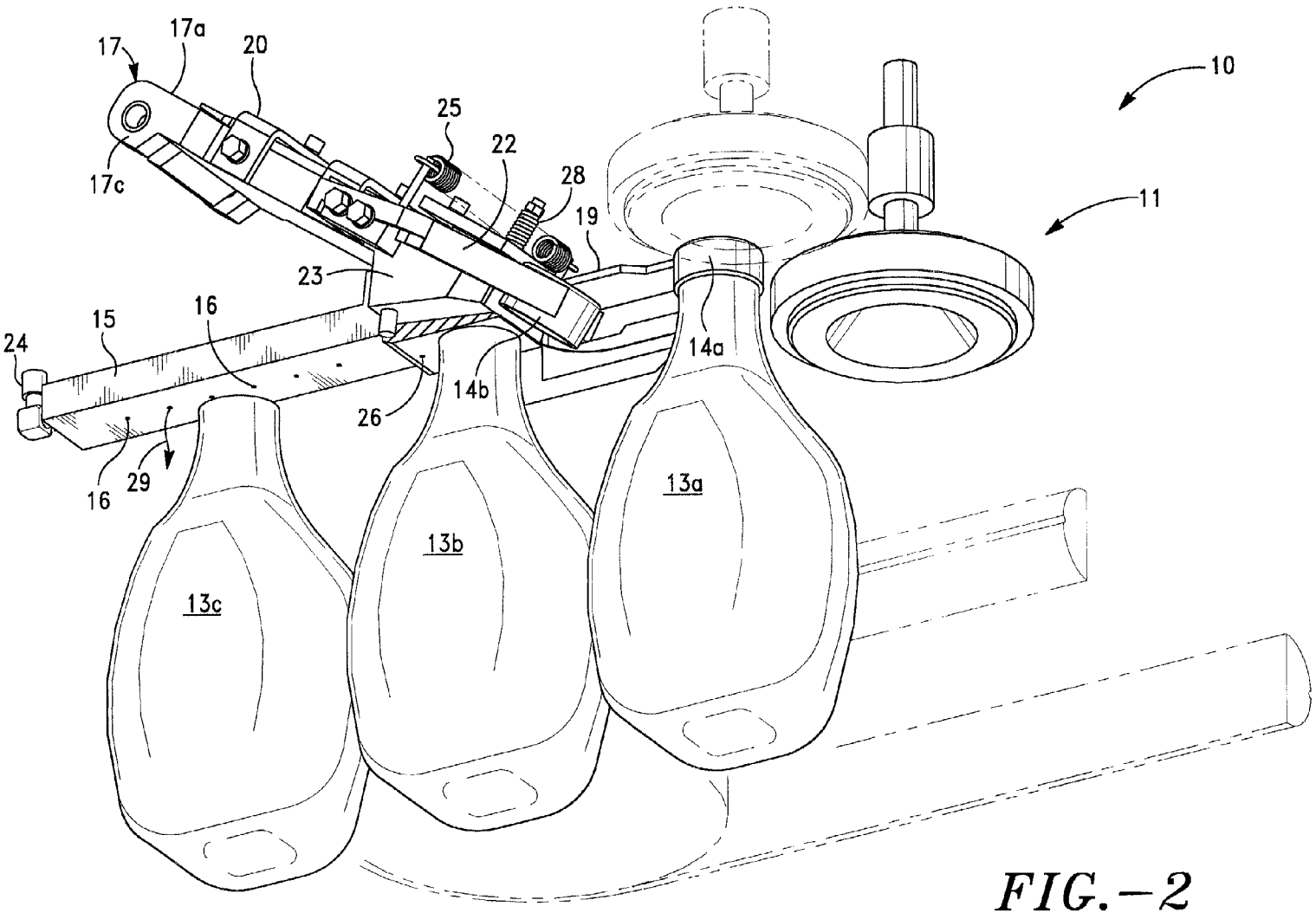
FIG. 2 is perspective bottom view of the capping assembly shown in FIG. 1.
Figure 3:
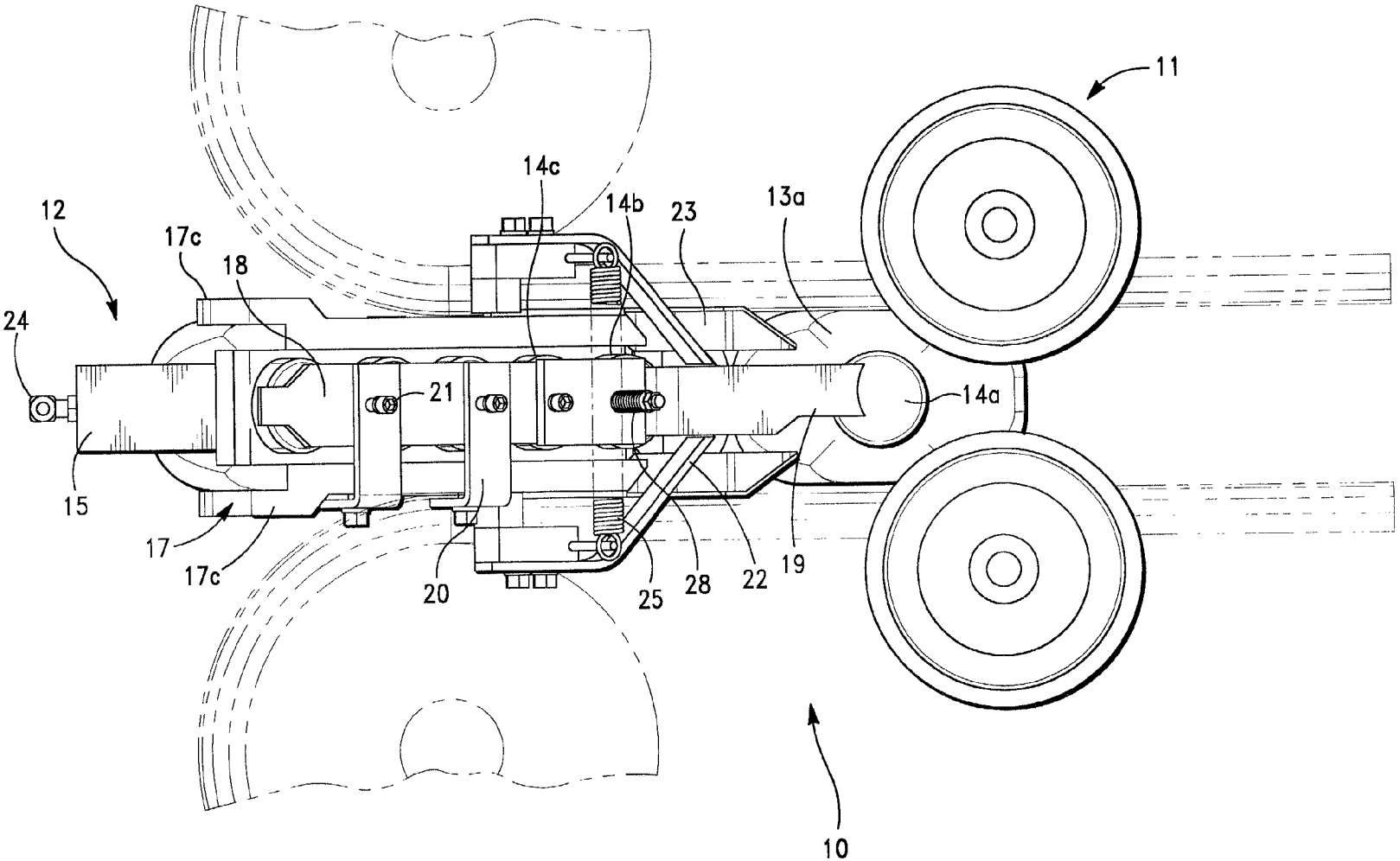
FIG. 3 is a top plan view of the capping assembly shown in FIG. 1.

In referring to FIGS. 1–3, a capping assembly 10 of the present invention is shown. The capping assembly 10 may be part of a well-known in-line capping assembly such as that provided in U.S. Pat. No. 5,669,209 and incorporated herein by reference. The capping assembly 10 may include a roller or disc subassembly 11 and a chute end subassembly 12. While the roller subassembly 11 is shown for purposes of illustration with only one pair of opposed rollers, the present invention contemplates that a plurality of pairs of opposed rollers may be employed in a fashion similar to that described in U.S. Pat. No. 5,669,209. As such, the chute end subassembly 12 may, in part, provide a supply of caps that are placed on openings of in-line moving containers, such as about 275 to 600 containers per minute, while the downstream roller subassembly 11 tightens the caps onto the moving containers.

In FIGS. 1–3, a plurality of containers 13*a*–13*c* is depicted as moving in-line such as from a conveyor belt (not shown). For illustration, a first cap 14*a* has been placed on the opening of the first container 13*a* and is ready to be at least partially tightened by the roller subassembly 11 (FIGS. 1 and 3). A second cap 14*b* is shown at a dispensing end of the chute end subassembly 12 for placement on the second container 13*b* (FIG. 2). A third cap 14*c* is loaded in the chute end subassembly 12 upstream of the second cap 14*b* (FIG. 3) for placement on the third container 13*c*. The third container 13*c* is upstream of and following the second container 13*b* towards the dispensing end of the chute end subassembly 12.

As better seen in FIG. 4*a*, the third container 13*c* may be receiving through its opening at least one non-oxygen bearing fluid stream 29 at a first fluid station, as described below. Concurrently, the second container 13*b* may be at the dispensing end of the chute end subassembly 12 and nearing the second cap 14*b*. The second container 13*b* may then be receiving through its opening at least one non-oxygen bearing fluid stream 26 at a second fluid station, as further described below. In FIG. 4*b*, the second container 13*b* has moved further down the capping line and is adjacent to the second cap 14*b*. At such point, the second container may still be receiving at least one non-oxygen bearing fluid stream 26. However, it may also be receiving at least one non-oxygen bearing fluid stream 31 at a third fluid station, and which stream 31 is being directed into the cap 14*b* and deflected into the second container 13*b* as will be described below in greater detail. Accordingly, it can be seen that the present invention can provide a "continuous injection" of at least one non-oxygen bearing fluid stream into each container until a cap is placed on the container. In other words, at any given time, each container is receiving at least one fluid stream, whether in the form of the fluid stream 26, 29, or 31 at one of a plurality of fluid injection stations.

The continuous injection of at least one non-oxygen bearing fluid stream into each container is provided by the chute end subassembly 12 that can include a fluid manifold 15. Although the manifold 15 may be of various configurations, it generally extends longitudinally along and parallel to the path of the in-line moving containers 13*a*–13*c*. The fluid manifold 15 may receive a first fluid via a fluid inlet 24 disposed, in this embodiment, at an end of the manifold 15 opposite the dispensing end of the chute end subassembly 12. The first fluid into the manifold 15 may be in the form of a non-oxygen bearing fluid.

Figure 5A:
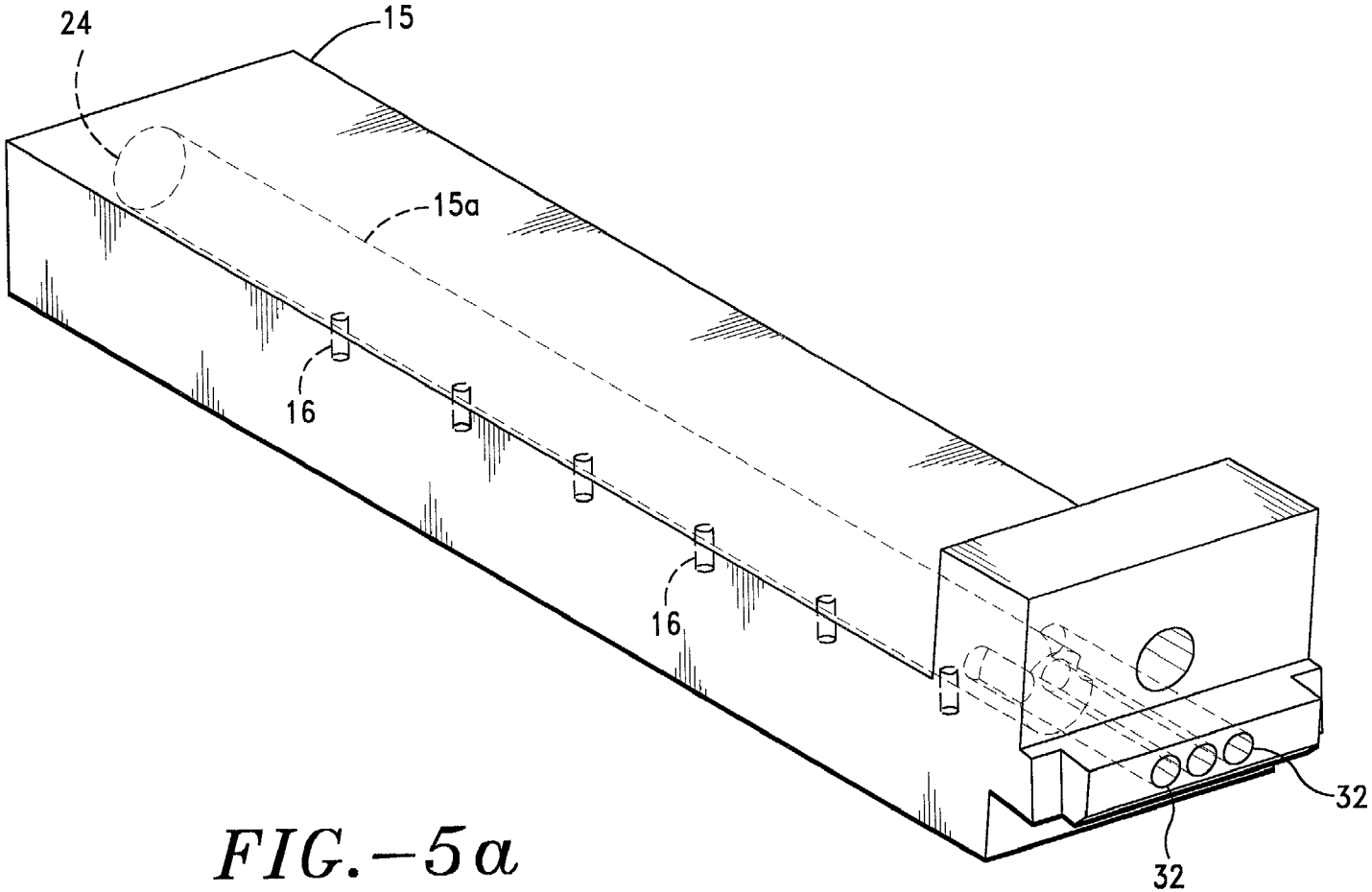
FIG. 5*a* is a perspective view of a fluid manifold that can be employed in the chute end subassembly of the present invention.

As better seen in FIGS. 2 and 5*a*, the manifold 15 may provide a plurality of first manifold apertures or nozzles 16 at a first fluid injection station. The first apertures 16 may or may not be equally spaced apart, and may or may not be of the same configuration and dimension as further described below. A plurality of second manifold apertures 32 may be provided at the end of the manifold 15 opposite the fluid inlet 24. The second manifold apertures 32 may receive the first fluid from the fluid inlet 24 via a manifold channel 15*a* that extends along the longitudinal length of the manifold (FIG. 5*a*). The second manifold apertures 32 may then provide fluid communication between the manifold 15 and a fluid shoe 23 of the chute end subassembly 12, as described in detail below. The first apertures 16 may receive the first fluid from the inlet 24 via the manifold channel 15*a* to provide a continuous injection of the first fluid in the form of a plurality of first fluid streams 29 into the moving containers 13*a*–13*c*.

What is meant by "continuous injection" into the containers vis-à-vis the manifold 15 is that, for each container 13*a*–13*c*, at least one first fluid stream 29 is always flowing into each container as each container passes along the manifold 15. As an example, in FIG. 2, the third container 13*c* may receive the first fluid stream 29 out of the third from the left aperture 16 of the manifold 15. As the third container 13*c* moves to the right, when viewed from FIG. 2, the third container 13*c* may receive the first fluid stream 29 out of the fourth from the left aperture 16. However, there is no time during which the third container 13*c* does not receive the first fluid stream 29 from either the third or fourth from the left apertures 16.

Figure 5B:
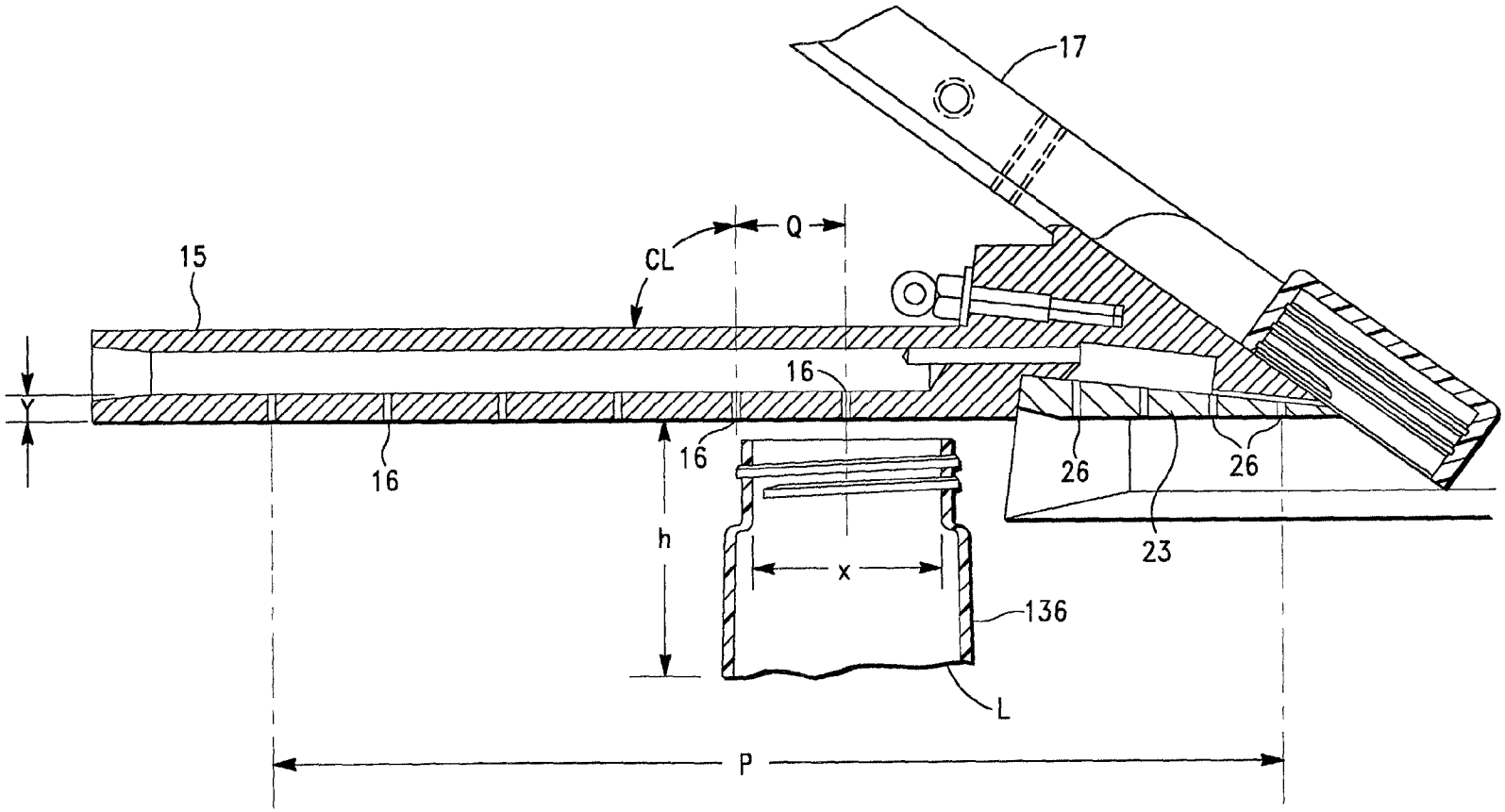
FIG. 5*b* is a schematic side view of the fluid manifold in FIG. 5*a* and a fluid shoe of the chute end subassembly according to an embodiment of the present invention.

The manner of providing continuous fluid injection from the manifold 15 is further depicted in FIG. 5*b*. Therein, one or more of the first nozzles 16 from the manifold 15 may be oriented towards the horizontal plane of the container 13*b* opening at an angle "α". The first nozzles 16 have a length "Y" while a distance "Q" separates the equally spaced apart nozzles 16. The container 13*b* can be characterized by an opening diameter "x". A distance "h" separates the bottom of the nozzle 16 and the content level "L" in the container. In the event two nozzles 16 are desired to continuously inject fluid into a single container 13, then Q<x.

In this embodiment, the first fluid streams 29 may also be in a "continuous flow" in that the first fluid streams 29 are always flowing out of the manifold 15, as opposed to first streams 29 only flowing out of the manifold 15 at intervals. Nevertheless, the present invention contemplates that the first fluid streams 29 may be provided non-continuously, or at intervals, such as when the total amount of the first fluid may be reduced for purposes of savings. Further, the first fluid streams 29 may not be provided on "continuous injection" basis into the containers such as when containers are not present or when the container conveyor is stopped.

As better seen in FIG. 1*a*, the chute end subassembly 12 may further include a longitudinally extending frame 17 having a pair of opposed side sections 17*c* and bottom section therebetween (not shown). The frame 17 may further have a receiving end 17*a* and an opposed dispensing end 17*b* (FIGS. 1–3). At the receiving end 17*a*, the frame 17 is configured and dimensioned to receive the plurality of caps 14*a*–14*c* and enable the caps to move in-line due to gravity and towards the dispensing end 17*b*. The caps 14*a*–14*c* may be guided through the frame 17 by a guide 18 that is opposite from the bottom section. The guide 18 may be a planar element that extends along the length of the frame 17 and that may interface the caps 14*a*–14*c* to keep the caps aligned. The guide 18 can be supported by a pair of guide mounts 20, with the guide mounts 20 being affixed to the frame 17. An adjusting bolt 21 can be associated with each mount 20 to adjust an amount of clearance between the guide 18 and the caps 14*a*–14*c* as the guide 18 interfaces the caps 14*a*–14*c*. Thereby, different sized height caps 14*a*–14*c* may be utilized with a single frame 17.

A pair of arms or jaws 22 may also be provided by the chute end subassembly 12 and located at the dispensing end 17*b* of the frame 17. One end of each arm 22 may be rotatably affixed at each side of the frame 17 and intermediate the receiving end 17*a* and the dispensing end 17*b*. The other or free end of each arm 22 may then be disposed immediately adjacent the dispensing end 17*b*. Thereby, the arms 22 may rotate about an axis such that the free ends of the arms 22 may come towards and away from one another. The amount of rotation or movement of the free ends of the arms 22 may be controlled by a tension spring 25 interposed between the arms 22.

Consequently, and due to their configuration and dimension, the free ends of the arms 22 can receive the caps 14 from the frame 17. Upon receiving the caps 14, the free ends of the arms 22 can hold the caps 14 in an orientation whereby the open sides of the caps 14 face the third fluid streams 31, as shown in FIG. 4*b*. While the orientation may vary, the orientation may be described by an acute angle between a plane of the opening of the cap and a horizontal plane to the neck finish of the opening of the container and that is typically between about 0 to 90° (FIG. 5*b*). In such orientation, a moving container can pull a cap 14 from the arms 22 as the container passes by the free ends of the arms 22. The amount of force necessary for a cap 14 to be released from the arms 22 and placed onto the opening of a container 13 is controlled by the tension spring 25.

A wiper 19 can be disposed and supported at the dispensing end 17*b* of the frame to place a cap end 19*a* of the wiper 19 operatively adjacent the arms 22. The wiper 19 may be supported by the frame 17 by being affixed to the guide 18. A compression spring 28 can be provided proximate the end of the wiper 19 that is opposite the cap end 19*a*. The compression spring 28 may control the amount of compression at the cap end 19*a*, and which compression is placed on a cap 14. In operation, after a container 13 has pulled or picked the cap 14 out the arms 22, the cap 14 may not be parallel to a plane of the opening of the container 13. If not parallel, the downstream roller subassembly 11 may not be able to tighten the cap 14 onto the container 13. To prevent such occurrences, the cap end 19*a* of the wiper 19 places and/or depresses the cap 14 onto the opening such that the cap 14 is oriented parallel to the plane of the container 14 opening.

Figure 6:
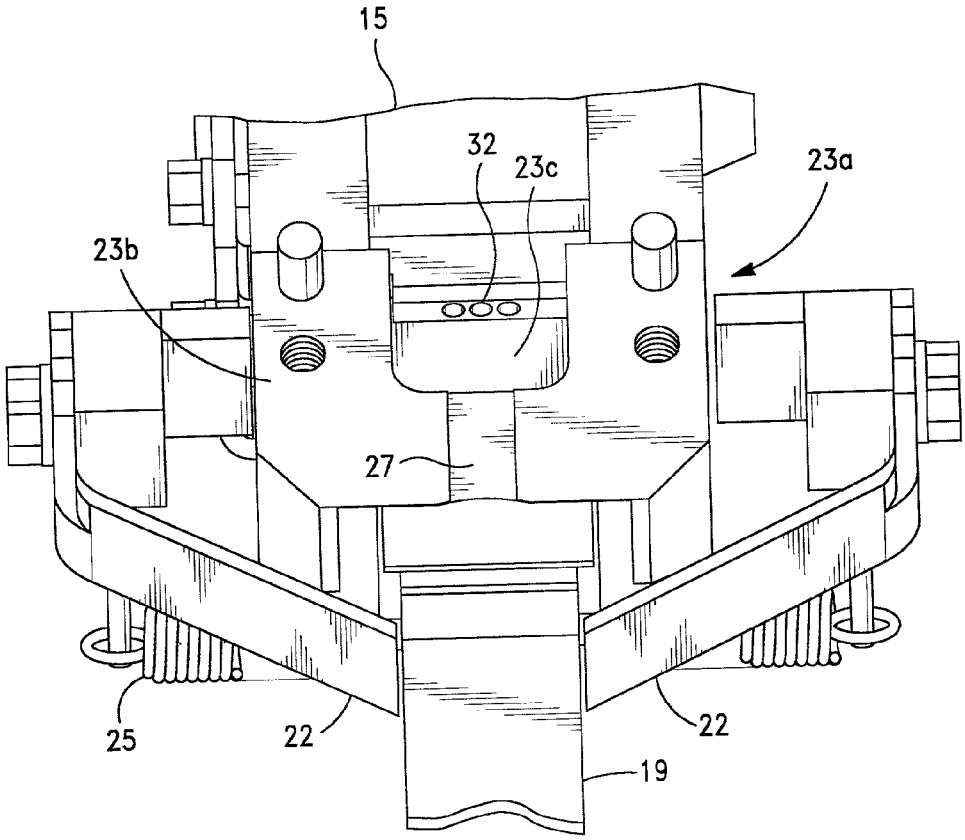
FIG. 6 is a partial bottom perspective view of the chute end subassembly having a base portion of a fluid shoe that can be employed in the chute end subassembly of the present invention.

As mentioned above, and shown in FIG. 6, the chute end subassembly 12 may also include a fluid shoe 23 that is supported by the frame 17 and is in fluid communication with the fluid manifold 15. In FIG. 6, a base portion 23*a* of the fluid shoe 23 is adjacent the second manifold fold apertures 32 of the manifold 15. The base portion 23*a* can form a part of a shoe chamber 23*c* that may receive the first fluid via the second manifold apertures 32. From the shoe chamber 23*c*, the first fluid may exit through a shoe aperture or nozzle 27 that is also formed by a part of the base portion 23*a*.

Figure 7:
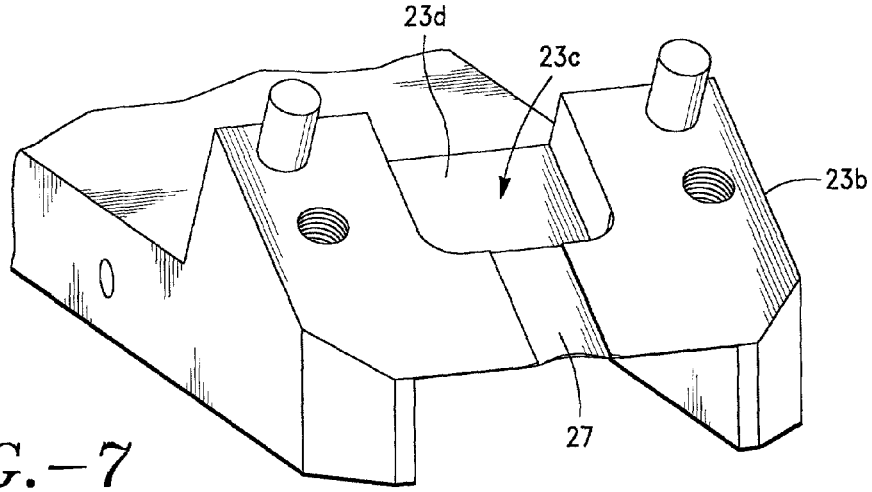
FIG. 7 is a partial perspective view of the base portion shown in FIG. 6.

FIG. 7 depicts a cover portion 23*b* of the fluid shoe 23 that can mate to the base portion 23*a*. The cover portion 23*b* may form the corresponding part of the shoe chamber 23*c* and the shoe aperture or nozzle 27.

In referring back to FIGS. 4*a*–4*b*, the shoe aperture 27 can dispense a second non-oxygen bearing fluid in the form of second fluid streams 31 into the caps 14. Upon entering the caps 14, the second fluid streams 31 may be deflected into the container 13. Because the shoe aperture 27 is in fluid communication with the shoe chamber 23*c*, the second fluid that comprises the second fluid streams 31 may be the same as the first fluid from the manifold 15. Alternatively, the second fluid may different than the first fluid, and may be in the form of an inert fluid. Further, the shoe aperture 27 may have a curved configuration to match the curved configuration of the cap 14. With such curved aperture 27, the cap 14 may more readily pass out of the frame 17 and onto the container 13 opening.

Figure 4A:
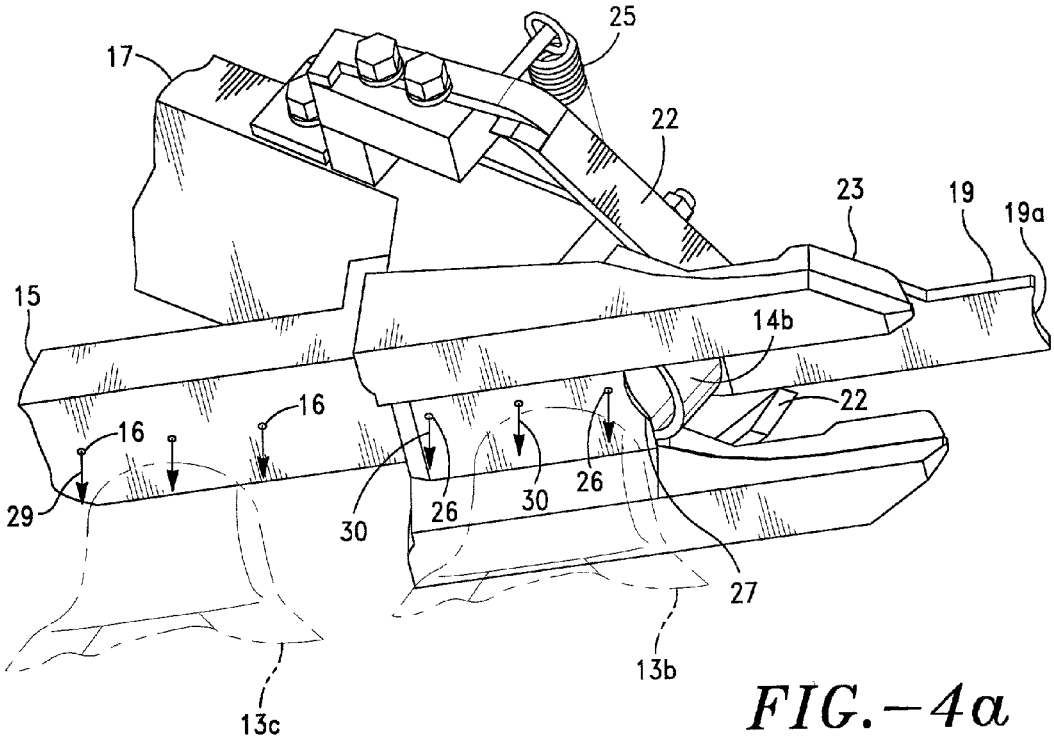
FIG. 4*a* partial perspective bottom view of a chute end subassembly that can be employed in the capping assembly of the present invention, with a container approaching a cap to be placed on the container.
Figure 4B:
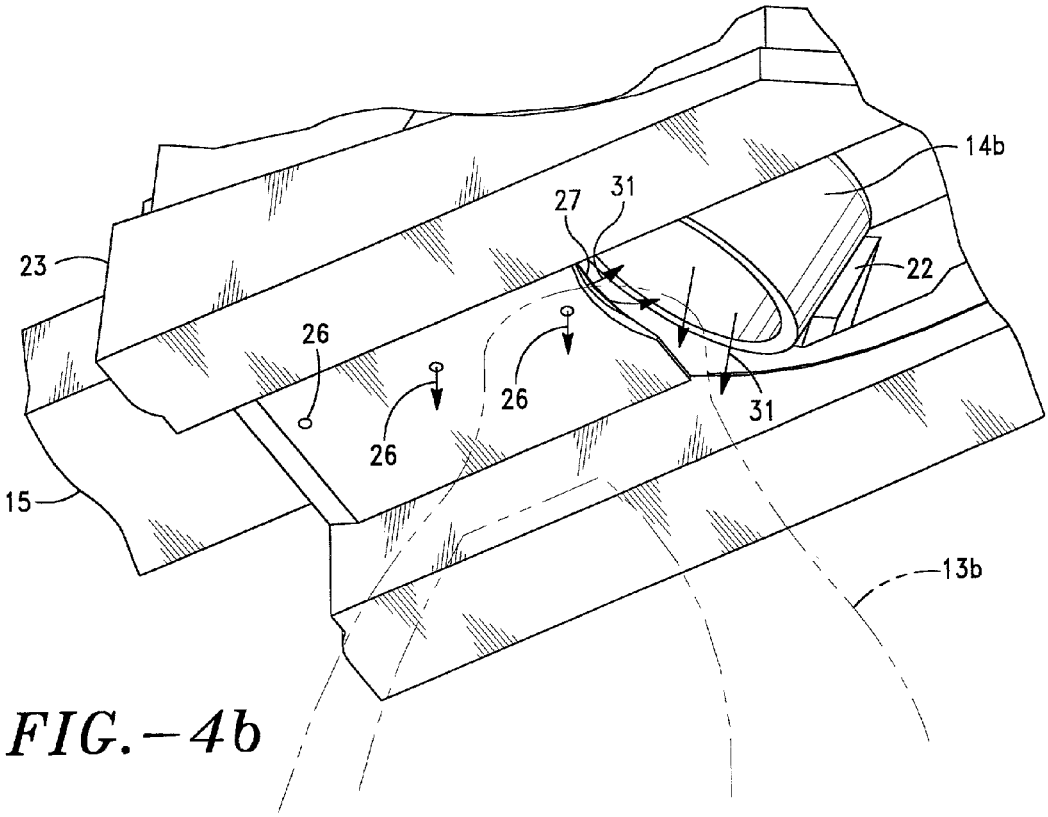
FIG. 4*b* is a partial perspective bottom view of the chute end subassembly of FIG. 4*b*, with the container at the cap to be placed on the container.

In FIGS. 4*a*–4*b*, it can also be seen that the fluid shoe 23 can further provide a plurality of shoe apertures or nozzles 26. In turn, the apertures or nozzles 26 are in fluid communication with the shoe chamber 23*c*. Thereby, a third non-oxygen bearing fluid that comprises the third fluid streams 30 exiting from the apertures 26 may be the same as the first fluid from the manifold 15, as well as the second fluid. Nevertheless, the present invention contemplates that the third fluid may be different from the first and/or second fluids, may also be in the form of a non-oxygen bearing fluid, and be provided by a source other than the manifold 15. Additionally, even though the embodiment of FIGS. 4*a*–4*b* depicts three in-line nozzles 26 of the same dimension and equally spaced, the invention is not so limited.

Figure 8A:
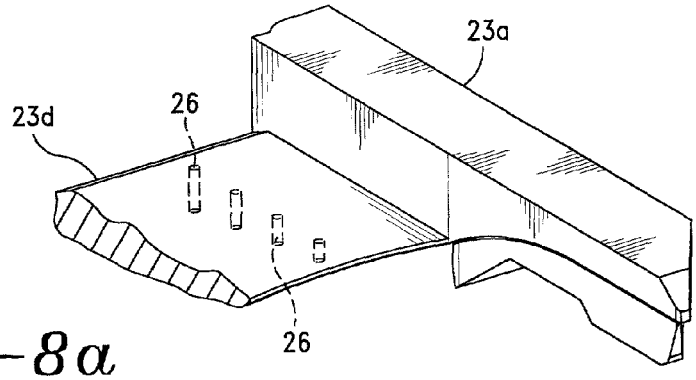
FIG. 8*a* is a partial perspective view of one embodiment of a cover portion of the fluid shoe shown in FIG. 6.
Figure 8B:
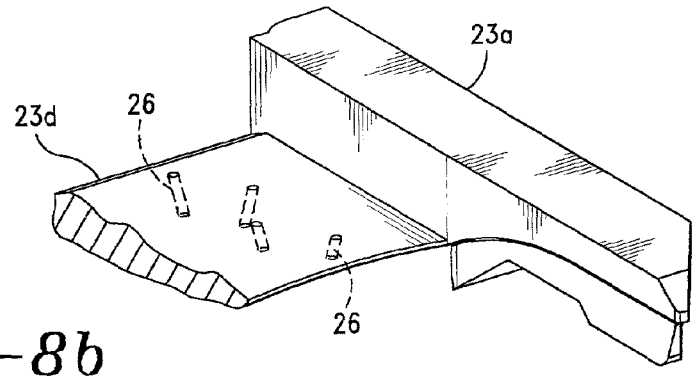
FIG. 8*b* is a partial perspective view of a second embodiment of a cover portion of the fluid shoe shown in FIG. 6.
Figure 8C:
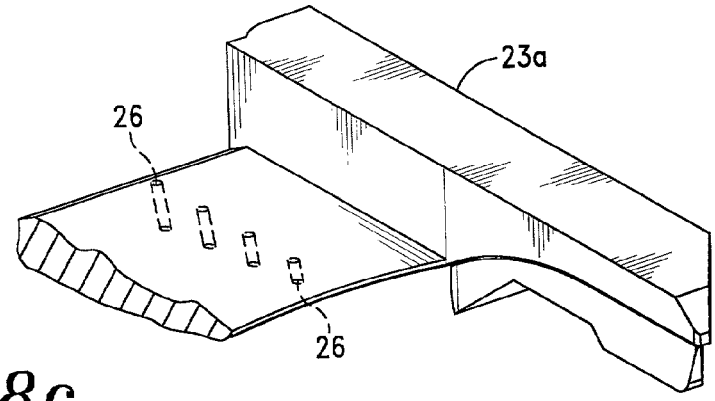
FIG. 8*c* is a partial perspective view of a third embodiment of a cover portion of the fluid shoe shown in FIG. 6.
Figure 8D:
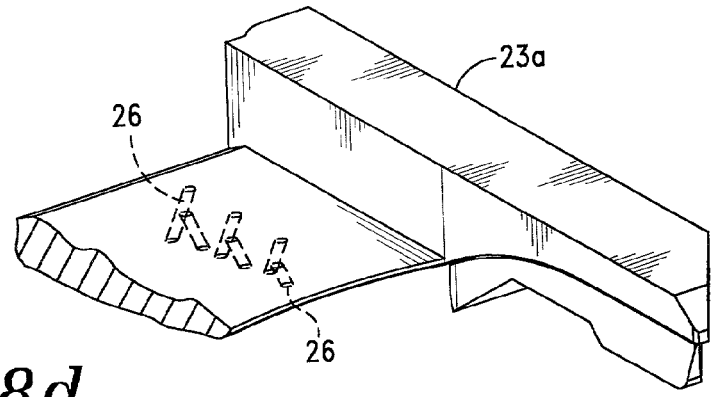
FIG. 8*d* is a partial perspective view of a fourth embodiment of a cover portion of the fluid shoe shown in FIG. 6.
Figure 8E:
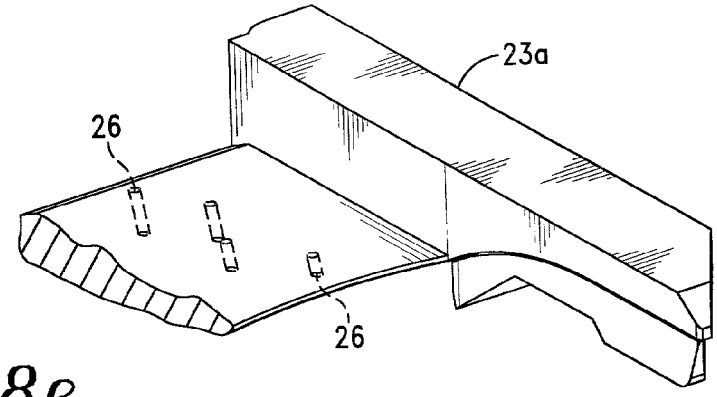
FIG. 8*e* is a partial perspective view of a fifth embodiment of a cover portion of the fluid shoe shown in FIG. 6.

For example, FIGS. 8*a*–8*e* show some alternative embodiments of the nozzles 26. In FIG. 8*a*, four in-line nozzles 26 are depicted generally perpendicular to the wall 23*d* of the shoe chamber 23*c*. FIG. 8*b* shows two rows of nozzles 26, with each nozzle angled to the chamber wall 23*d* at an angle other than about 90°. FIG. 8*c* shows four in-line nozzles 26 at an acute angle to the chamber wall 23*d*. In FIG. 8*d*, six in-line nozzles 26 are provided, with three nozzles 26 at an acute angle to the chamber wall 23*d* and three other nozzles 26 at an obtuse angle to the chamber wall 23*d*. In FIG. 8*e*, two rows of nozzles 26 are generally perpendicular to the chamber wall 23*d*. Notwithstanding the foregoing examples, the present invention contemplates that other numbers, rows, and orientations of the nozzles 26 may be employed.

Figure 9:
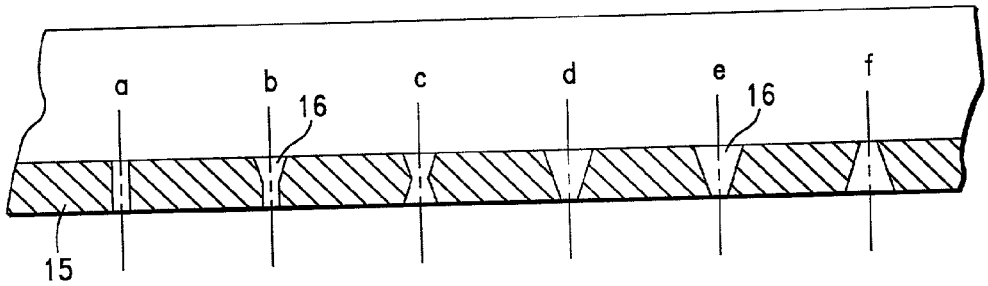
FIGS. 9*a*–9*f* are schematic side views of various embodiments of a nozzle that can be employed in a fluid manifold and/or fluid shoe of the chute end subassembly of the present invention.

Furthermore, the configurations of the shoe nozzles 26 themselves in the shoe 23 may vary and, consequently, the pattern of the stream exiting therefrom may vary and be in the form of a cylinder or cone, as an example. Similarly, the configurations of the manifold nozzles 16 may vary, as well as their numbers, rows, and orientations. Some exemplary configurations for the nozzles 16 and 26 are depicted in FIGS. 9*a*–9*f*. The nozzles may be of configurations that are of a "cylindrical port" (FIG. 9*a*), a "radiused port" (FIG. 9*b*), a "port with two chamfers" (FIG. 9*c*), a "cylindrical hole with chamfer on gas side" (FIG. 9*d*), a "chamfered hole with larger radius on gas side" (FIG. 9*e*), and a "chamfered hole with larger radius on non-gas side" (FIG. 9*f*). Moreover, each of the nozzles 16 and 26 may be different from one another in configuration, dimension, and angle to the openings of the containers.

Despite the above variations, there are useful characteristics of the nozzles 16 and 26. In referring to FIG. 5*b*, when the distance "h" is between about 1 to 2 inches, then a length "Y" of the nozzle (16 or 26) throat may be between about 0.25 to 0.50 inches. With a manifold 15 inlet diameter to a single nozzle 16 outlet diameter ratio between about 4.5 to 1.0, a pressure drop across the nozzle 16 may be from about 15 to 25 psi. A useful angle $\alpha$ may be from about greater than 0° to less than 180°. A distance "P" between the first nozzle 16 and the last nozzle 26 may be from about 4 to 18 inches when the line speed is about 50 to 600 containers per minute. Nevertheless, it should be understood that the present invention envisions dimensions other than the foregoing to adapt to different operating environments, such as line speed and container configuration.

As can be appreciated by those skilled in the art, the present invention provides an improved apparatus and method of integrally removing air from the headspace of in line containers and capping the containers. By such integration, the present invention can provide continuous injection of an inert gas into the containers to expel the unwanted air up to the point where the caps are placed on the containers. Thus, the need for a vacuum or inert environment is eliminated. Further, by the integration of the inert gas injection and capping, in-line containers can be processed at speeds of at least 275 containers per minute and up to about 600 containers per minute. Higher (and even lower) in-line speeds may be achieved depending upon the configuration of the containers.

It should be understood, of course, that the foregoing relates to preferred embodiments of the invention and that modifications may be made without departing from the spirit and scope of the invention as set forth in the following claims.

We claim:

1. A cap chute end subassembly for capping a plurality of in-line containers in an ambient atmosphere, comprising:

a fluid manifold having a plurality of first manifold apertures for injecting a first non-oxygen bearing fluid into said plurality of containers;

a fluid shoe operatively adjacent said fluid manifold; said fluid shoe having a plurality of shoe apertures for dispensing a second non-oxygen bearing fluid into a plurality of caps and the plurality of containers;

wherein said plurality of shoe apertures comprise:

a plurality of first shoe apertures that inject said second fluid into said containers; and a second shoe aperture that injects said second fluid into said caps following the injection of said second fluid into said containers a frame that supports said fluid shoe, said frame being configured to receive the plurality of caps at a receiving end of said frame;

a wiper supported at a dispensing end of said frame; and a pair of arms operatively adjacent said fluid shoe, said pair of arms being configured to position at least one of the caps for receipt by at least one of the containers and to orient said at least one of the caps to the at least one of the containers.

2. The subassembly of claim 1, wherein said first non-oxygen bearing fluid and said second non-oxygen bearing fluid are the same.

3. The subassembly of claim 1, wherein said first non-oxygen bearing fluid and said second non-oxygen bearing fluid are a gas.

4. The subassembly of claim 1, wherein said pair of arms receives said plurality of caps at said dispensing end of said frame.

5. The subassembly of claim 4, wherein said pair of arms enables said containers to receive said caps.

6. The subassembly of claim 5, wherein said pair of arms holds said caps for injection of said second non-oxygen bearing fluid into said caps.

7. The subassembly of claim 6, wherein said pair of arms hold said caps at an acute angle to planes of openings of said containers.

8. The subassembly of claim 7, wherein said second non-oxygen bearing fluid is directed into said containers upon said second non-oxygen bearing fluid being injected into said caps.

9. The subassembly of claim 7, wherein said wiper places said caps parallel to said planes of openings after said second non-oxygen bearing fluid is injected into said caps.

10. The subassembly of claim 1, wherein said pair of arms are rotatably affixed to the frame.

11. The subassembly of claim 1, wherein said first non-oxygen bearing fluid and said second non-oxygen bearing fluid are a liquid.

12. A cap chute end subassembly for capping a plurality of in-line containers in an ambient atmosphere, comprising:

a gas manifold having a plurality of first manifold nozzles for injecting a gas into said plurality of containers;

a gas shoe operatively adjacent said gas manifold;

said gas shoe having a plurality of first shoe nozzles and a second shoe nozzle;

said first shoe nozzles for injecting said gas into said plurality of containers;

said second shoe nozzle for injecting said gas into a plurality of caps;

a frame that supports said gas shoe;

said frame being configured to receive the plurality of caps at a receiving end of said frame;

a wiper supported at a dispensing end of said frame;

a pair of arms operatively adjacent said gas shoe; and said pair of arms being configured to position at least one of the caps for receipt by at least one of the containers and to orient said plurality of caps such that said gas is directed into said plurality of caps and then into said plurality of containers.

13. The subassembly of claim 12, wherein said first manifold nozzles direct said gas in a direction substantially perpendicular to planes of openings of said plurality of containers.

14. The subassembly of claim 12, wherein said first shoe nozzles direct said gas in a direction substantially perpendicular to planes of openings of said plurality of containers.

15. The subassembly of claim 12, wherein said first shoe nozzles inject said gas into one of said containers after said first manifold nozzles inject said gas into said one of said containers.

16. The subassembly of claim 12, wherein said gas injected into said plurality of caps is subsequently directed into said plurality of containers.

17. The subassembly of claim 12, wherein said plurality of containers are moving in-line at least at about 275 containers per minute.

18. The subassembly of claim 12, wherein said pair of arms are rotatably affixed to the frame.

* * * * *

UNITED STATES PATENT AND TRADEMARK OFFICE

CERTIFICATE OF CORRECTION

PATENT NO. : 7,040,075 B2
APPLICATION NO. : 09/928058
DATED : May 9, 2006
INVENTOR(S) : Robert B. Seeberger et al.

It is certified that error appears in the above-identified patent and that said Letters Patent is hereby corrected as shown below:

On Title Page (75)
The inventor "Rober B.Seebeger" should be corrected to --Robert B.Seeberger--.

Signed and Sealed this

Sixth Day of March, 2007

JON W. DUDAS
*Director of the United States Patent and Trademark Office*